US008878694B2

(12) United States Patent
Davito

(10) Patent No.: US 8,878,694 B2
(45) Date of Patent: Nov. 4, 2014

(54) VEHICLE SPEED ADVISOR

(71) Applicant: Continental Automotive Systems, Inc., Auburn Hills, MI (US)

(72) Inventor: Farid Dergal Davito, Tlaquepaque (MX)

(73) Assignee: Continental Automotive Systems, Inc., Auburn Hills, MI (US)

( * ) Notice: Subject to any disclaimer, the term of this patent is extended or adjusted under 35 U.S.C. 154(b) by 52 days.

(21) Appl. No.: 13/692,120

(22) Filed: Dec. 3, 2012

(65) Prior Publication Data

US 2014/0152469 A1 Jun. 5, 2014

(51) Int. Cl.

| | |
|---|---|
| ***G08G 1/09*** | (2006.01) |
| ***G08G 1/0967*** | (2006.01) |
| ***G08G 1/0962*** | (2006.01) |

(52) U.S. Cl.

CPC ..... *G08G 1/0962* (2013.01); *G08G 1/0967* (2013.01)

USPC ..... 340/905; 340/936; 340/441; 701/117; 701/119

(58) Field of Classification Search

CPC ..... G08G 1/096725; G08G 1/096791; G08G 1/09675; G08G 1/20; B60W 2250/22; B60K 31/185; B60K 37/02; G01P 1/103

USPC ..... 340/905, 936, 441, 988, 438; 701/117, 701/119

See application file for complete search history.

(56) References Cited

U.S. PATENT DOCUMENTS

| | | | | |
|---|---|---|---|---|
| 6,778,074 | B1 * | 8/2004 | Cuozzo | 340/441 |
| 6,845,317 | B2 * | 1/2005 | Craine | 701/454 |
| 6,895,324 | B2 * | 5/2005 | Straub | 701/93 |
| 7,327,239 | B2 * | 2/2008 | Gallant et al. | 340/438 |
| 7,427,928 | B2 * | 9/2008 | Crocker et al. | 340/902 |
| 7,589,643 | B2 * | 9/2009 | Dagci et al. | 340/905 |
| 7,859,392 | B2 * | 12/2010 | McClellan et al. | 340/441 |
| 2011/0050459 | A1 * | 3/2011 | Vasireddy et al. | 340/905 |

* cited by examiner

*Primary Examiner* — Anh V La

(57) ABSTRACT

A vehicle speed advisor system that provides an indication of the local speed limit to the driver in order to warn the driver when the local speed limit has been exceeded. The system detects the actual GPS position and obtains the allowed local speed limit of that position in a USB or flash memory, which is then displayed using a speed limit indicator in the scale of the speedometer of the instrument cluster in one mode of operation when the speed limit has not been reached, or in a second mode of operation when the speed limit has been reached or surpassed. The driver does not have to look at the street to see the allowed driving speed because the instrument cluster always provides an indication of the local speed limit.

21 Claims, 3 Drawing Sheets

VEHICLE SPEED ADVISOR

FIELD OF THE INVENTION

The invention relates generally to a device used for providing an indication of the local speed limit during vehicle travel.

BACKGROUND OF THE INVENTION

Most vehicles are equipped with a speedometer used for providing an indication of the speed of the vehicle. There are many different types of speedometers, one type is a dial, or gauge, and others are digital, providing a numerical indication of the speed of the vehicle. Although typical speedometers provide an indication of vehicle speed, these types of devices do not provide an indication of the vehicle speed relative to the posted speed limit, or if the vehicle is travelling at speeds beyond the posted speed limit.

Therefore, there exists a need for a speedometer used for providing an indication of the speed of the vehicle, as well as providing an indication of whether the vehicle is travelling above the posted speed limits.

SUMMARY OF THE INVENTION

The present invention is a vehicle speed advisor system that provides an indication of the local speed limit to the driver in order to warn the driver when the local speed limit has been exceeded.

The system is a solution to allow the driver of the vehicle to look at the instrument cluster to view the allowed speed limit. The system has in one embodiment a Wi-Fi interface and a flash memory in order to upload the street information from a data base. Another embodiment includes a USB interface (or SD card, etc.) in order to read the local speed limit information.

The system determines the actual GPS position and obtains the allowed speed limit of that position in a USB or flash memory, which is then displayed in the scale of the speedometer of the instrument cluster. In one embodiment, the speed limit is displayed in green when the speed limit has not been reached, or in red when the speed limit has been reached or surpassed.

One of the advantages of the present invention is that the driver does not have to look at the street to see the allowed speed limit because the instrument cluster always provides an indication of the correct allowed speed. If there is no GPS signal, a telltale indicator warns the driver that the system is temporally out off range.

In an embodiment, the present invention is a vehicle speed advisor system, including a controller, a communication device in electrical communication with the controller, a memory device in electrical communication with the controller, and a device for indicating speed of a vehicle, such as a speedometer. The memory device may be a USB external memory device, an SD card, or other type of memory device suitable for storing data relating to local speed limits.

The speedometer is in communication with the controller, and the communication device provides location information regarding position of the vehicle to the controller. The controller receives information regarding local speed limits from the memory device, where information relating to local speed limits is stored. The controller then sends the local speed limit to the speedometer. The vehicle speed advisor system also includes a speed limit indicator, and the local speed limit is displayed by the speed limit indicator on the speedometer. In one embodiment, the communication device is a global positioning system (GPS) module, and in another embodiment, the system includes a second communication device, such as a WiFi communication device, which is used for obtaining information regarding local speed limits, and storing the local speed limits in a flash memory device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

A vehicle speed advisor system according to the present invention is shown in the Figures generally at 10. The system 10 includes a controller 12, a communication device, such as a global positioning system (GPS) module 14, and an interface, which in this embodiment is a USB interface 16. However, it is within the scope of the invention that other types of interfaces may be used. Both the GPS module 14 and the interface 16 are in electrical communication with the controller 12, and the controller 12 is in electrical communication with a device for indicating the speed of a vehicle, which in this embodiment is a speedometer, shown generally at 18.

Figure 1:
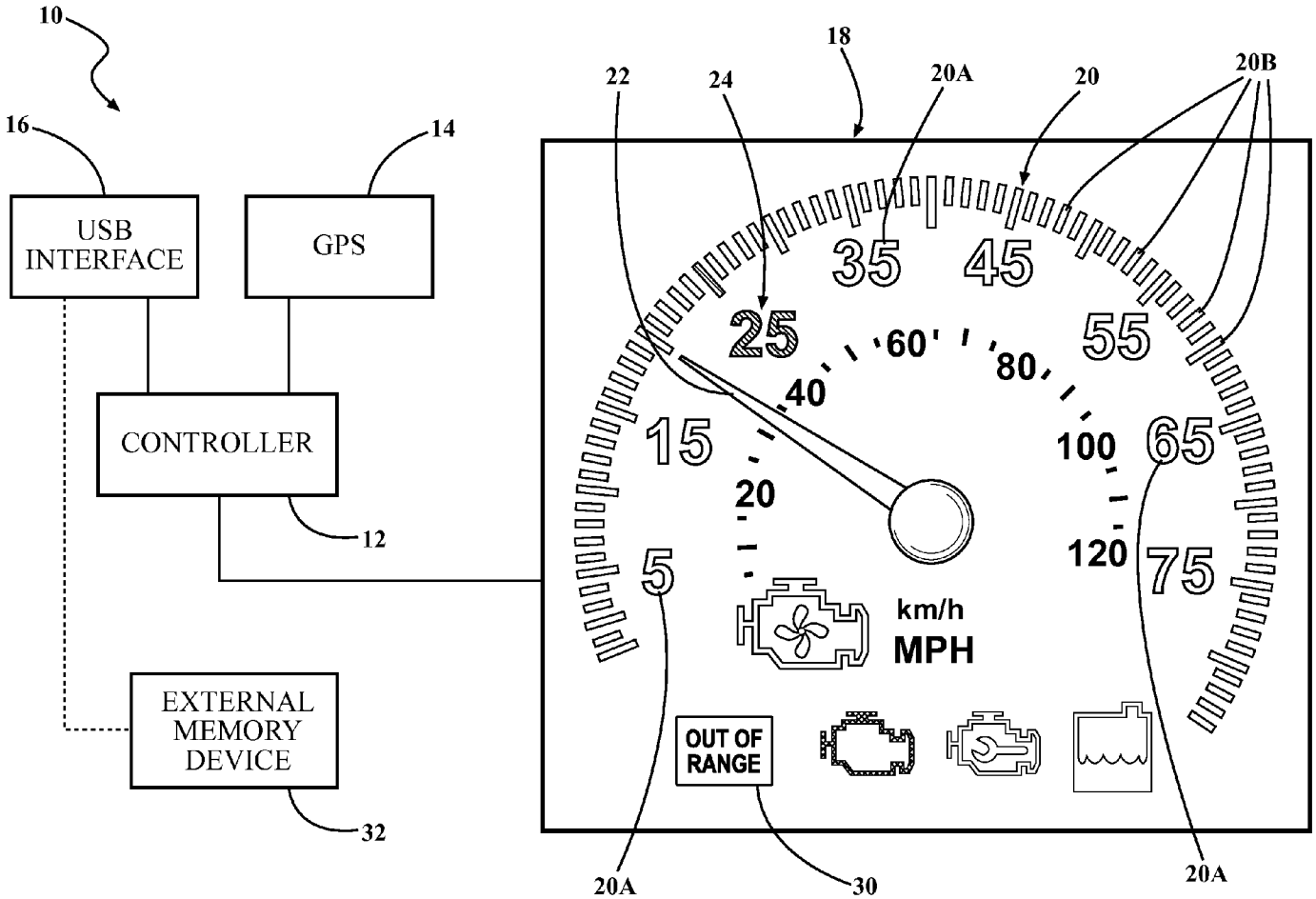
FIG. 1 is a diagram of a speed vehicle advisor system, according to the present invention.
Figure 2A:
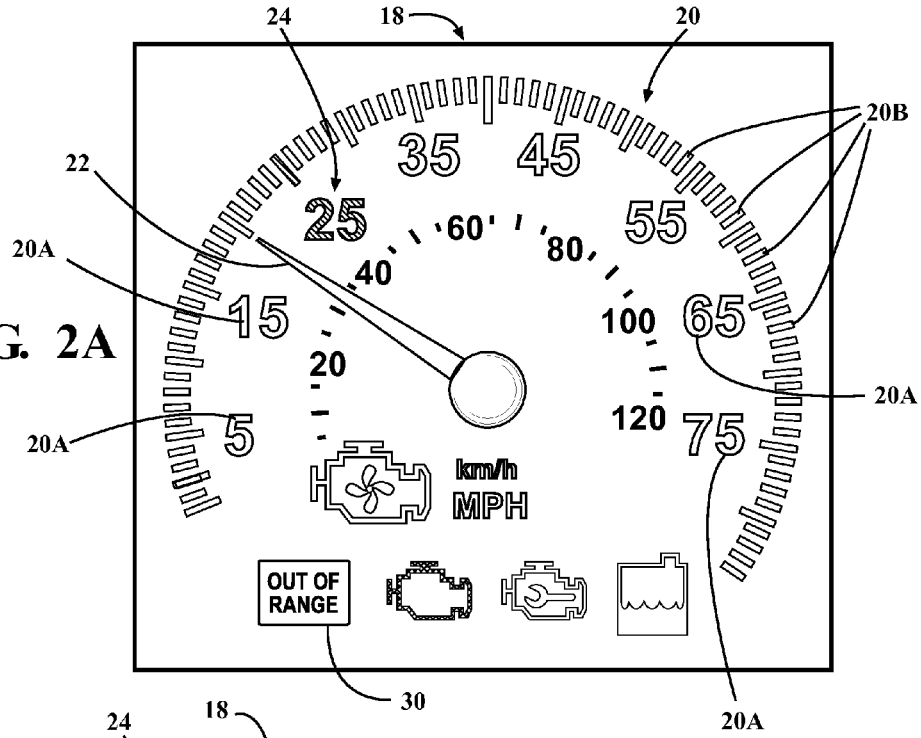
FIG. 2A is first a plan view of a speedometer having a speed limit indicator, according to embodiments of the present invention.

The speedometer 18 is mounted as part of the instrument cluster of the vehicle. While in this embodiment the speedometer 18 is shown, it is within the scope of the invention that the controller 12 may be connected to other devices used for monitoring the speed of the vehicle. In this embodiment, the speedometer 18 includes a dial, shown generally at 20 (also referred to as a scale 20), which includes several numerical indicators 20A and incremental indicators 20B. The speedometer 18 also includes a needle 22 which aligns with the proper indicator 20A,20B on the dial 20 to provide an indication of the speed of the vehicle. The speedometer 18 also includes a speed limit indicator 24 which is used to provide an indication of the local speed limit. In this embodiment, the speed limit indicator 24 is in the form of a highlighted numerical indicator 20A on the dial 20. In the example shown in FIGS. 1-3, the speed limit indicator 24 has highlighted the "25 mph" numerical indicator 20A on the dial 20. However, as will be explained, the speed limit indicator 24 may be used with any other indicator 20A,20B on the dial 20.

During travel of the vehicle, the GPS module 14 provides an indication of the location of the vehicle. The interface 16 is used to access the local speed limits from information stored on a memory device 32. The controller 12 communicates with the GPS module 14 to receive the location of the vehicle, the controller 12 then accesses the memory device 32 through the use of the USB interface 16 to obtain the correct speed limit which corresponds to the vehicle's current location. In this embodiment, an external memory device 32 is connected to the USB interface 16. More specifically, the external memory device 32 is a USB external memory device 32. However, is it within the scope of the invention that other types of memory devices may be used, such as, but not limited to, a Secure Digital (SD) card, or microSD card. The controller 12 then communicates with the speedometer 18 such that the speed limit indicator 24 is activated, highlighting the indicator 20A, 20B which corresponds to the proper speed limit on the dial 20.

Figure 2B:
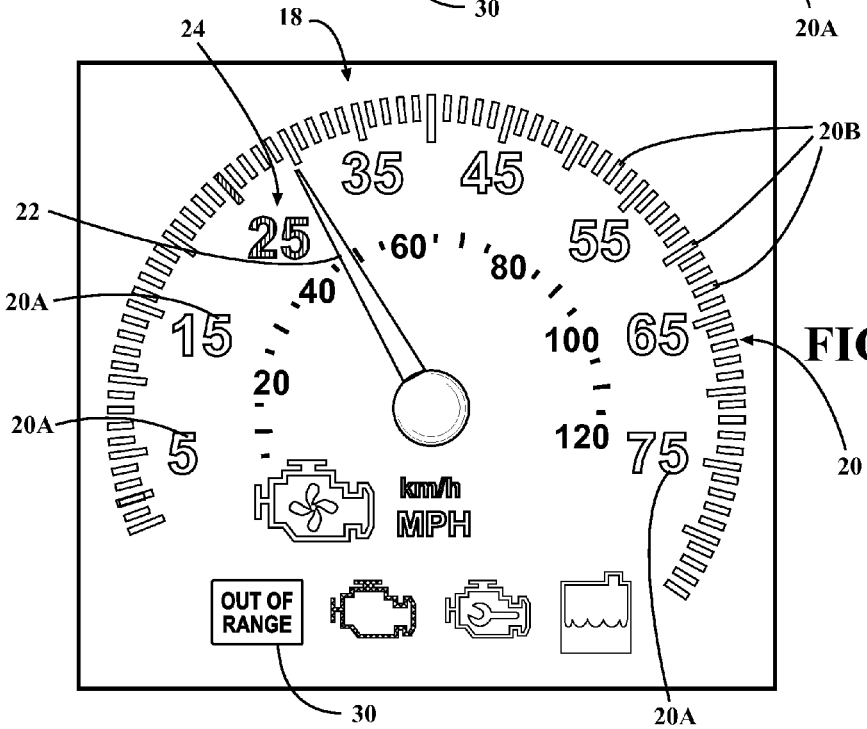
FIG. 2B is a second plan view of a speedometer having a speed limit indicator, according to embodiments of the present invention.

The speed limit indicator 24 has two modes of operation, the first mode of operation provides an indication that the vehicle is travelling below the local speed limit. The second mode of operation provides an indication that the vehicle is travelling at or above the local speed limit. In the embodiments shown in FIGS. 1-3, the speed limit indicator 24 functions to indicate that the vehicle is travelling either above or below the local speed limit, shown as the indicator 20A corresponding to 25 mph. More specifically, in the first mode of operation, the local speed limit is indicated by using a first highlighted color, such as green, shown in FIGS. 1 and 2A, when the vehicle is travelling below the posted speed limit of 25 mph, as shown by the needle 22. Referring to FIG. 2B, the second mode of operation of the speed limit indicator 24 is shown, where the local speed limit is indicated by using a second highlighted color, such as red, and the needle 22 is at or beyond the indicator 20A corresponding to the local speed limit. While the use of highlighting the indicator 20A corresponding to the local speed limit with different colors has been described, it is within the scope of the invention that speed limit indicator 24 may include other types of signals that may be used with the indicators 20A,20B to inform the driver when the vehicle is travelling below the speed limit, at the speed limit, or above the speed limit, such as a flashing light, the size of the indicator 20A,20B or combinations thereof.

The speed limit indicator 24 fluctuates between the first mode of operation and the second mode of operation as the vehicle travels between various speeds which are either greater or less than the local speed limit.

Figure 3:
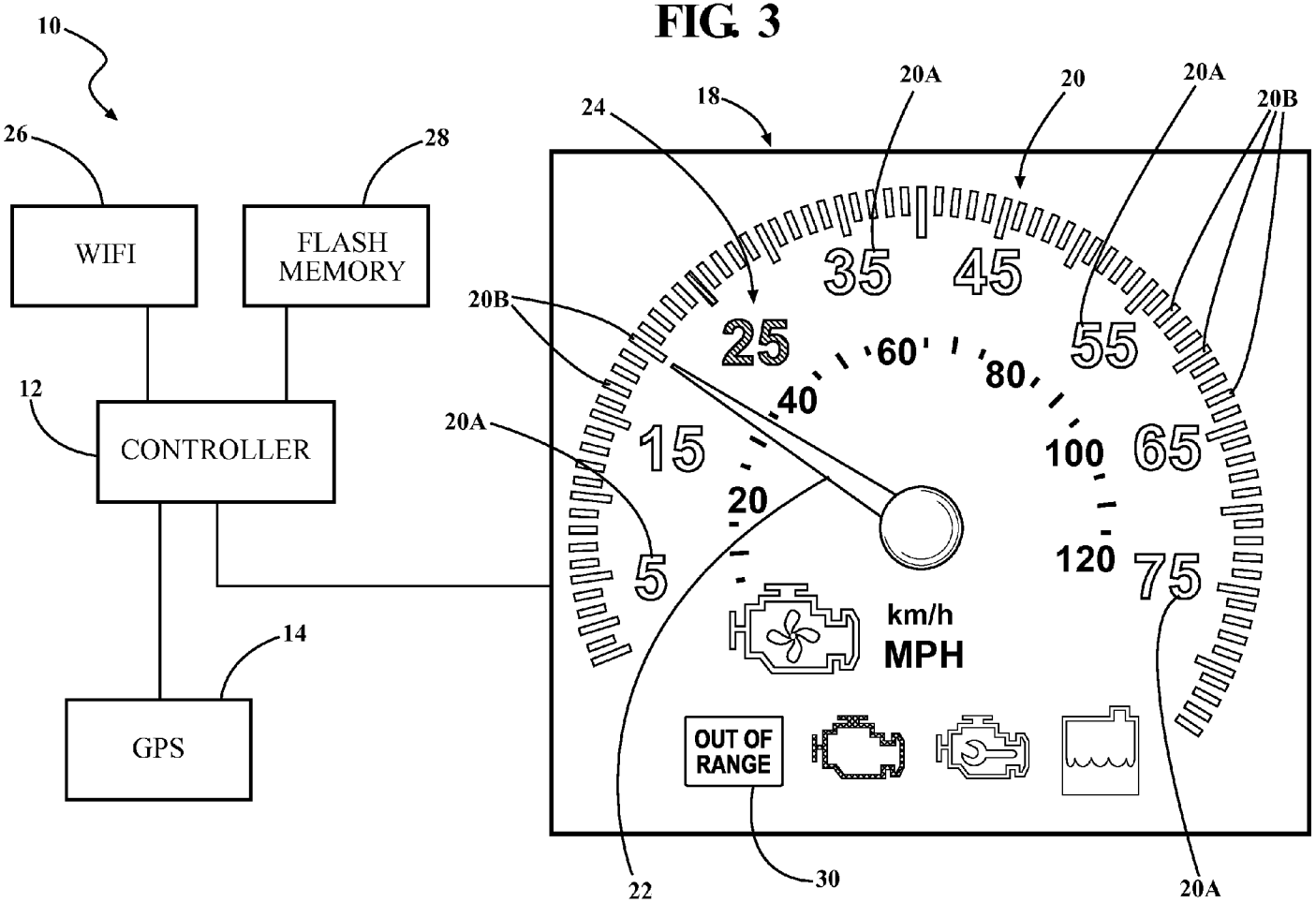
FIG. 3 is a diagram of an alternate embodiment of a speed vehicle advisor system, according to embodiments of the present invention.

Referring to FIG. 3, an alternate embodiment of the present invention is shown, with like numbers referring to like elements. In this embodiment, there is a second communication device 26, which in this embodiment is a WiFi communication device 26 which is in electrical communication with the controller 12, and a flash memory device 28, which is also in electrical communication with the controller 12. The WiFi communication device 26 is able to connect to local WiFi networks to obtain information regarding local maps, as well as updates regarding local maps. The controller 12 then receives this information and stores it in the flash memory device 28 for access as needed. Information regarding local speed limits is stored on the flash memory device 28 as well, and the local speed limits are obtained from local WiFi networks by using the WiFi communication device 26. In the embodiment shown in FIG. 3, the GPS module 14 is used to provide an indication of the location of the vehicle, and the controller 12 communicates with the GPS module 14 to receive the location of the vehicle. The controller 12 then accesses the flash memory device 28 to obtain the correct speed limit which corresponds to the current location of the vehicle. Once the correct speed limit is obtained by the controller 12, the controller 12 then communicates with the speedometer 18 such that the speed limit indicator 24 is activated, highlighting the proper indicator 20A,20B which corresponds to the proper speed limit on the dial 20.

One of the advantages of the present invention is that a driver travelling in an unfamiliar area is made aware of local speed limits by using the instrument cluster, and more specifically, the speedometer 18. Furthermore, the driver of the vehicle does not have to look at a posted sign to determine the local speed limit, but rather the driver may view the speedometer 18, and the local speed limit is highlighted by the speed limit indicator 24.

The present invention also includes a telltale indicator 30 which has two modes of operation. In a first mode of operation, the telltale indicator 30 blinks to provide an indication that there is no signal for the GPS module 14 to receive, and that the system is temporally out off range. In the second mode of operation of the telltale indicator 30, the telltale indicator 30 is in a lighted or turned on condition (not blinking) to provide an indication that there is a problem with the system 10, such as a failure in the system, that the database cannot be found, or some other type of malfunction.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a vehicle speed advisor system, including:

a controller;

a communication device in electrical communication with the controller;

a memory device in electrical communication with the controller;

a device for indicating speed of a vehicle, the device for indicating vehicle speed in communication with the controller; and a telltale indicator having a first mode of operation for providing an indication that the communication device is unable to provide the location information to the controller, and a second mode of operation to provide an indication that there is a malfunction in the vehicle speed advisor system;

wherein the communication device provides location information regarding location of the vehicle to the controller, and the controller receives information regarding local speed limits from the memory device based on the location information, and the controller sends the local speed limit to the device for indicating speed of a vehicle.

2. The apparatus of claim 1, further comprising a speed limit indicator, wherein the local speed limit is displayed by the speed limit indicator on the device for indicating the speed of a vehicle.

3. The apparatus of claim 2, the speed limit indicator further comprising two modes of operation.

4. The apparatus of claim 3, the first mode of operation further comprising a first type of display when the vehicle is traveling below the local speed limit.

5. The apparatus of claim 4, the second mode of operation further comprising a second type of display when the vehicle is travelling at or above the local speed limit.

6. The apparatus of claim 1, wherein the communication device is a global positioning system (GPS) module.

7. The apparatus of claim 1, further comprising a second communication device for obtaining information regarding local speed limits.

8. The apparatus of claim 7, the second communication device further comprising a WiFi communication device.

9. The apparatus of claim 1, wherein the memory device is one from the group consisting of a flash memory device, an SD card, a USB external memory, and combinations thereof.

10. The apparatus of claim 1, the device for indicating speed of a vehicle further comprising a speedometer.

11. A method for providing an indication of the local speed limit in a vehicle, comprising the steps of:

providing a controller;

providing a device for indicating the speed of a vehicle;

providing a speed limit indicator for use with the device for indicating the speed of a vehicle;

providing a global positioning system (GPS) module in communication with the controller;

providing a memory device in communication with the controller, the memory device having a data base with a plurality of local speed limits;

providing a telltale indicator in communication with the GPS module, the controller, the device for indicating the speed of a vehicle, and the speed limit indicator;

using the GPS module to obtain the location of the vehicle, such that the controller may read the location of the vehicle from the GPS module;

using the controller to communicate with the memory device to obtain one of the plurality of local speed limits based on the location of the vehicle obtained by the GPS module;

using the telltale indicator in a first mode of operation to provide an indication that the GPS module is unable to provide the location information to the controller, and in a second mode of operation to provide an indication that there is a malfunction in one of the controller, the device for indicating the speed of the vehicle, the speed limit indicator, the GPS module, or the memory device; and using the speed limit indicator to present one of the plurality of local speed limits on the device for indicating speed of a vehicle.

12. The method of claim 11, further comprising the steps of providing the device for indicating the speed of a vehicle to be a speedometer.

13. The method of claim 11, further comprising the steps of providing the memory device to be one selected from the group consisting of a flash memory device, a USB external memory, an SD card, and combinations thereof.

14. The method of claim 11, further comprising the steps of providing the speed limit indicator to have a first mode of operation when the vehicle is travelling below the local speed limit, and a second mode of operation when the vehicle is travelling at or above the local speed limit.

15. The method of claim 11, further comprising the steps of providing a WiFi communication device for providing information regarding local speed limits.

16. A vehicle speed advisor system, comprising:

a global positioning system (GPS) module for detecting the location of a vehicle;

a controller in electrical communication with the GPS module;

a speedometer in electrical communication with the controller;

a speed limit indicator in electrical communication with the controller; and a telltale indicator having a first mode of operation for providing an indication that the GPS module is unable to provide the location information to the controller, and a second mode of operation to provide an indication that there is a malfunction in the vehicle speed advisor system;

wherein the controller receives location information from the GPS module, and commands the speed limit indicator to display the local speed limit on the speedometer based on the location of the vehicle.

17. The vehicle speed advisor system of claim 16, further comprising:

an interface in electrical communication with the controller; and an external memory device in electrical communication with the interface;

wherein the controller retrieves the local speed limit from the external memory device through the interface.

18. The vehicle speed advisor system of claim 17, the interface further comprising a USB interface.

19. The vehicle speed advisor system of claim 17, the external memory device further comprising one from the group consisting of a microSD card, an SD card, and combinations thereof.

20. The vehicle speed advisor system of claim 16, the speed limit indicator further comprising a first mode of operation when the vehicle is travelling below the local speed limit, and a second mode of operation when the vehicle is travelling at or above the local speed limit.

21. The vehicle speed advisor system of claim 16, further comprising:

a WiFi communication device for receiving information regarding local speed limits; and a flash memory device operable for storing the information regarding local speed limits received by the WiFi communication device.

* * * * *